US006848353B2

(12) United States Patent
Hattori

(10) Patent No.: US 6,848,353 B2
(45) Date of Patent: Feb. 1, 2005

(54) HYDRAULIC DEVICE

(75) Inventor: Masakazu Hattori, Gifu (JP)

(73) Assignee: Teijin Seiki Co., Ltd., Tokyo (JP)

( * ) Notice: Subject to any disclaimer, the term of this patent is extended or adjusted under 35 U.S.C. 154(b) by 0 days.

(21) Appl. No.: 10/618,592

(22) Filed: Jul. 15, 2003

(65) Prior Publication Data

US 2004/0065191 A1 Apr. 8, 2004

(30) Foreign Application Priority Data

Oct. 7, 2002 (JP) ..... 2002-293324

(51) Int. Cl.[7] ..... F15B 13/00
(52) U.S. Cl. ..... 91/418; 91/459; 91/461
(58) Field of Search ..... 91/418, 437, 466, 91/459, 461

(56) References Cited

U.S. PATENT DOCUMENTS 2,976,852 A * 3/1961 Goldring ..... 91/459
3,158,068 A * 11/1964 Bokelman ..... 91/439
3,818,800 A * 6/1974 Bertaux ..... 91/418
4,011,887 A 3/1977 Raymond
4,150,686 A * 4/1979 El Sherif et al. ..... 91/459
5,297,469 A 3/1994 Raymond
6,435,205 B1 8/2002 Hattori et al.
6,530,220 B2 * 3/2003 Porter et al. ..... 60/478

FOREIGN PATENT DOCUMENTS

DE 4227563 2/1994

* cited by examiner

*Primary Examiner*—Edward K. Look
*Assistant Examiner*—Igor Kershteyn
(74) *Attorney, Agent, or Firm*—Venable LLP; Andrew C. Aitken

(57) ABSTRACT

A hydraulic device includes a passage block with a first hole, an internal body received in the first hole connected to a hydraulic module and an actuator. The actuator has a cylindrical shell integrally connected at its one side to the passage block and projecting at its other side from the passage block. The passage block has a first and second passageway to communicate the hydraulic module with a groove means on the internal body, and a third passageway to communicate the groove means with a first chamber of the actuator. A connecting member connects the fluid distributor unit to the other side of the actuator to communicate the groove means with a second chamber of the actuator.

20 Claims, 13 Drawing Sheets

HYDRAULIC DEVICE

BACKGROUND OF THE INVENTION

1. Field of the Invention

The present invention relates to a hydraulic device having an actuator to drive, for example, control surfaces such as flaperon, ailerons, spoiler, elevators and rudders of aircraft, a hydraulic module to control supply of a working fluid for the actuator, and a fluid distributor unit to hydraulically communicate between the actuator and the hydraulic module.

2. Description of the Related Art

A conventional hydraulic device of this kind is disclosed in, for example, Japanese patent laying-open publication Tokkai 2001-165103 (corresponding to U.S. Pat. No. 6,435,205) and comprises a passage block formed with a columnar space in the central portion thereof and fluid passage portions formed inside of the passage block, an internal body received in the columnar space and formed on the circumferential surface of the internal body with channels connected to the fluid passage portions, an actuator attached to a lower surface of the passage block to drive a control surface of an aircraft, and a fluid-controlled valve as a hydraulic module attached to an upper surface of the passage block to control supply and discharge of a high-pressure fluid for the actuator through the fluid passage portions of the passage block and the channels of the internal body.

The fluid passage portions of the passage block comprise a first head-site and rod-site feed/exhaust passage portion formed in the passage block at the upper side of it, and a second head-site and rod-site feed/exhaust passage portion formed in the passage block at the lower side of it. The first head-site and rod-site feed/exhaust passage portions connect the channels of the internal body and the fluid-controlled valve to each other, and the second head-site and rod-site feed/exhaust passage portions connect the channels of the internal body and the actuator to each other.

The actuator comprises a casing extending back and forth and defining a cylinder chamber therein, a piston slidably received in the cylinder chamber and partitioning it into a head-site chamber and a rod-site chamber, and a piston rod integrally attached to the piston and passing through a front end wall of the casing. The head-site and rod-site chambers of the actuator are respectively connected on the lower surface of the passage block to a second head-site and rod-site feed/exhaust passage portions.

The above known conventional hydraulic device, however, encounters such a problem that the passage block becomes longer in an axial direction of the actuator and heavier as a length of the actuator becomes longer, because the connections between the second head-site and rod-site feed/exhaust passage portions of the passage block and the head-site and rod-site chambers of the actuator need to be arranged at each end portion of the cylinder chamber to supply and discharge the high-pressure fluid to and from the head-site and rod-site chambers so that the piston can move between one end and the other end of cylinder chamber.

It is, therefore, an object of the present invention to provide a hydraulic device which overcomes the foregoing drawbacks and can reduce the axial length and the weight of the passage block.

It is another object of the present invention to provide a hydraulic device which can be easily manufactured and reduce its manufacturing cost.

SUMMARY OF THE INVENTION

According to the first aspect of the present invention there is provided a hydraulic device comprising: a reservoir tank reserving a working fluid; a hydraulic pump sucking in the working fluid from the reservoir tank to increase in pressure and output the working fluid; a fluid distributor unit hydraulically connected to the hydraulic pump to be supplied with the working fluid from the hydraulic pump and having a passage block formed with a first hole inside thereof and an internal body incorporated fluid-tightly in the first hole of the passage block and formed with a groove on an outer surface of the internal body, the fluid distributor being provided with a passageway means hydraulically connected to the groove; a hydraulic module mounted on the passage block and having a first valve means that controls supply of the working fluid in the passageway means; an actuator mounted on the passage block and comprising a cylindrical shell which has a first end portion and a second end portion and is formed with a cylinder chamber inside thereof, a piston which is movable in the cylinder chamber and defines the cylinder chamber into a first and second chamber at the first and second end portion side of the piston respectively, and a piston rod connecting to the piston and disposed inside of the second chamber; a connecting member having a first and second end portion and connecting at the first end portion of the connecting member to the fluid distributor unit and at the second end portion of the connecting member to the actuator; the first end portion of the cylindrical shell being integrally connected to the passage block, and the second end portion of the cylindrical shell projecting outward in the axial direction of the actuator from the passage block; the connecting member being formed with a channel inside thereof to hydraulically communicate the groove of the internal body and the second chamber of the actuator with each other; the passageway means of the passage block being provided with a first and second passageway to hydraulically communicate the first valve means of the hydraulic module and the groove of the internal body with each other, and a third passageway to hydraulically communicate the groove of the internal body and the first chamber of the actuator with each other, and a fourth passageway to hydraulically communicate the groove of the internal body and the channel of the connecting member with each other.

BRIEF DESCRIPTION OF THE DRAWINGS

The objects, features and advantages of the present invention will become apparent as the description proceeds when taken in conjunction with the accompanying drawings in which.

DESCRIPTION OF THE PREFERRED EMBODIMENTS

Figure 1:
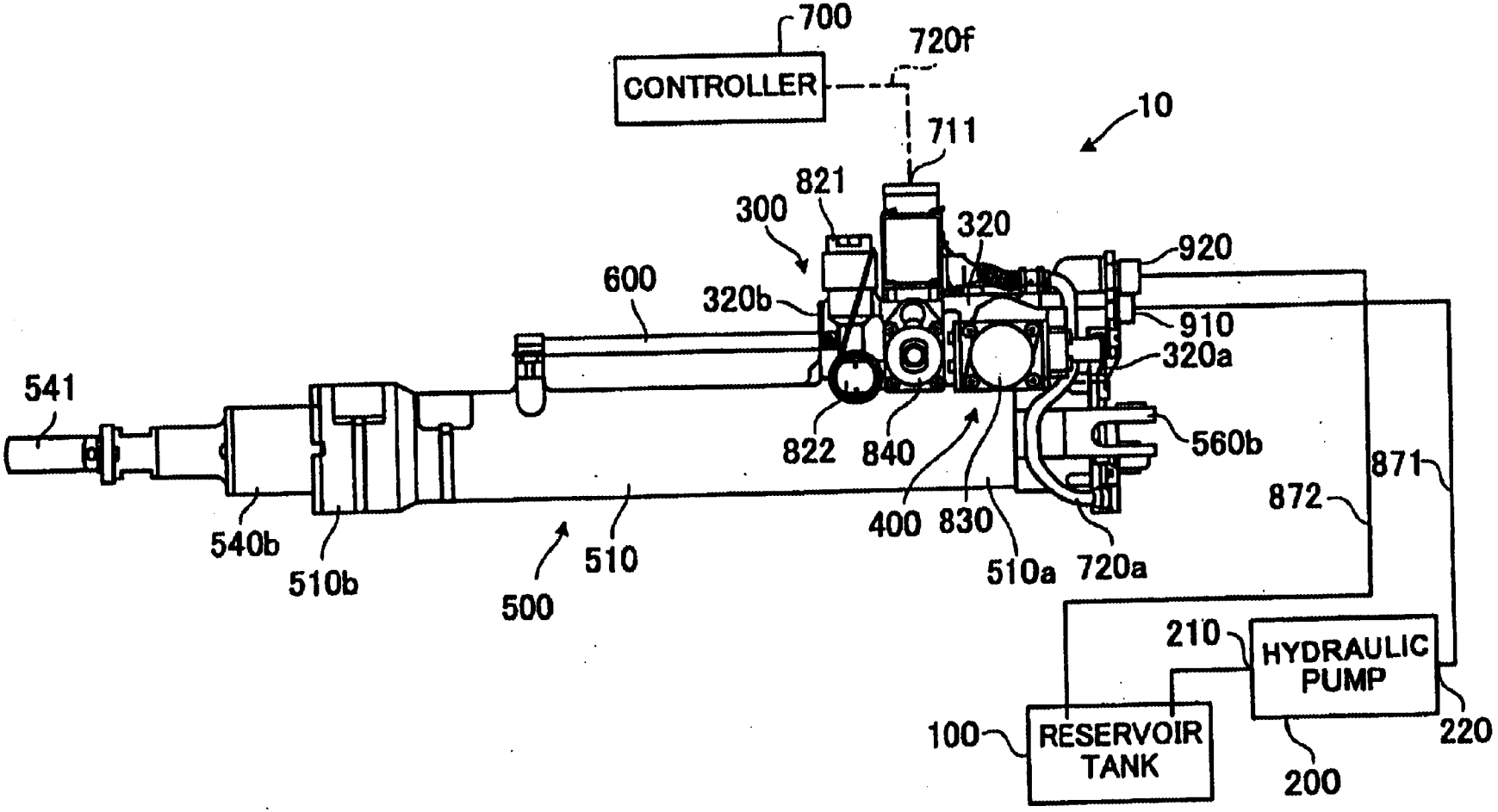
FIG. 1 is a side view showing a first preferred embodiment of the hydraulic device according to the present invention.

The preferred embodiment of the hydraulic device according to the present invention will be described hereinlater with reference to the drawings.

Throughout the following detailed description, similar reference characters and numbers refer to similar elements in all figures of the drawings.

In the following description, it is to be understood that words such as "upper", "lower" and "left" are used as a matter of convenience for easy understanding and do not necessarily mean actual directions.

Figure 2:
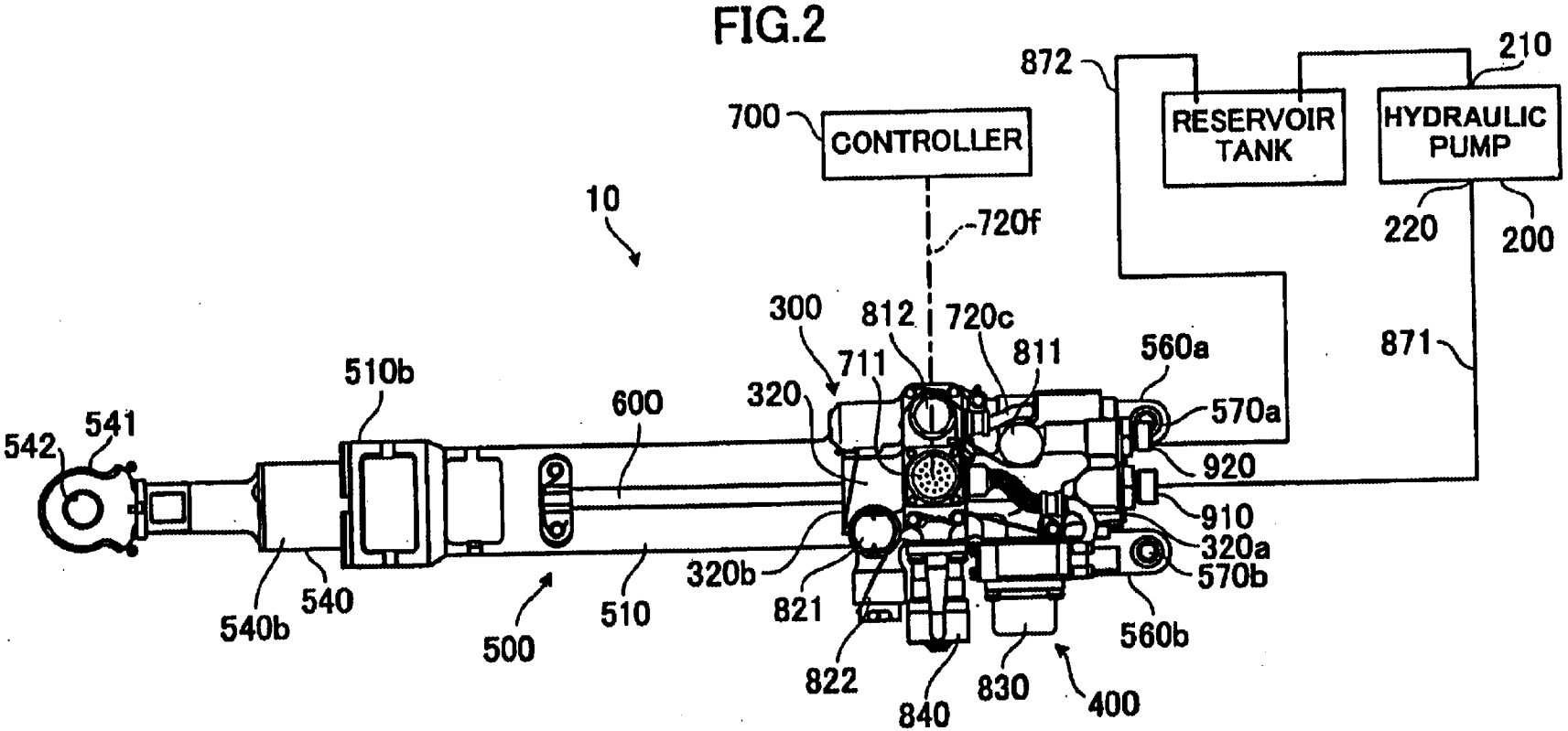
FIG. 2 is a plain view of the hydraulic device.
Figure 3:
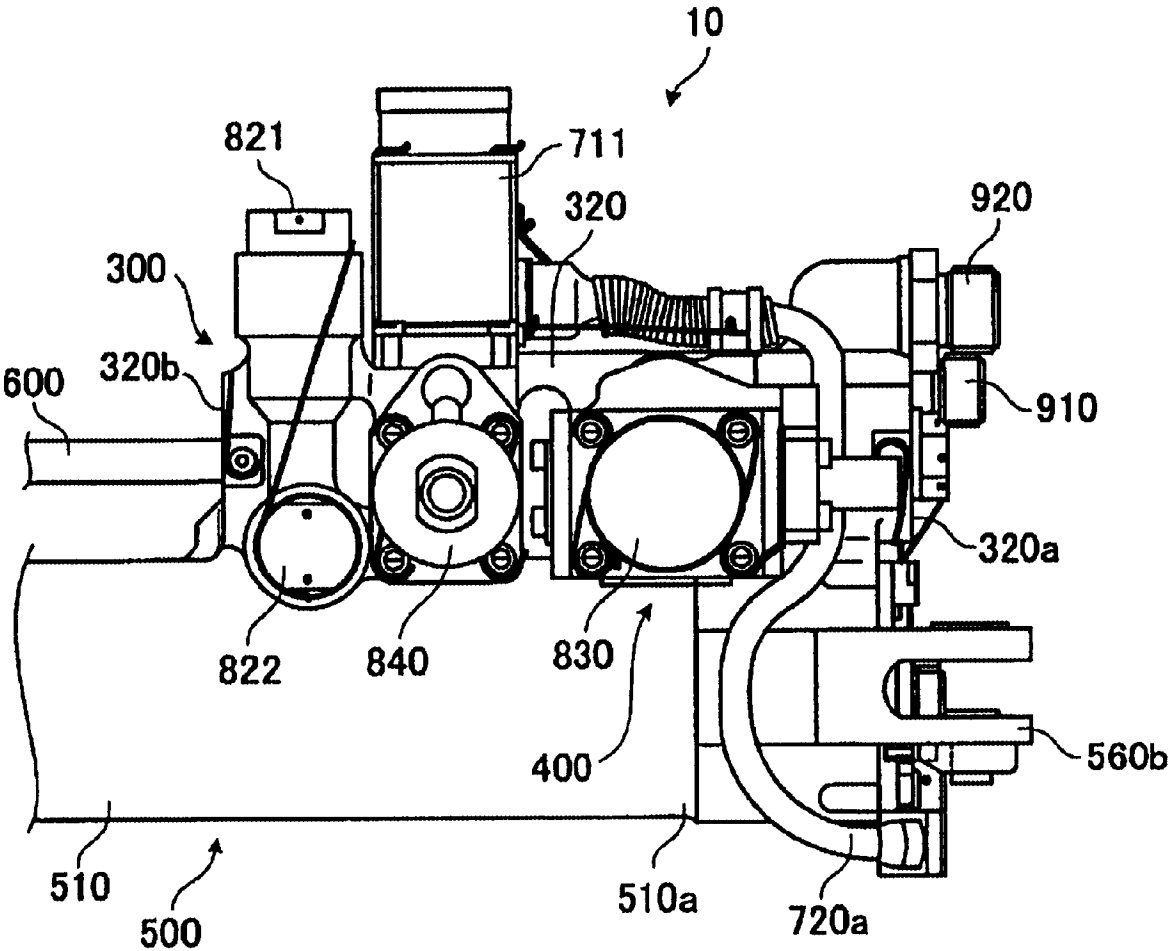
FIG. 3 is an enlarged fragmentary side view of the front end portion of the hydraulic device shown in FIG. 1.
Figure 4:
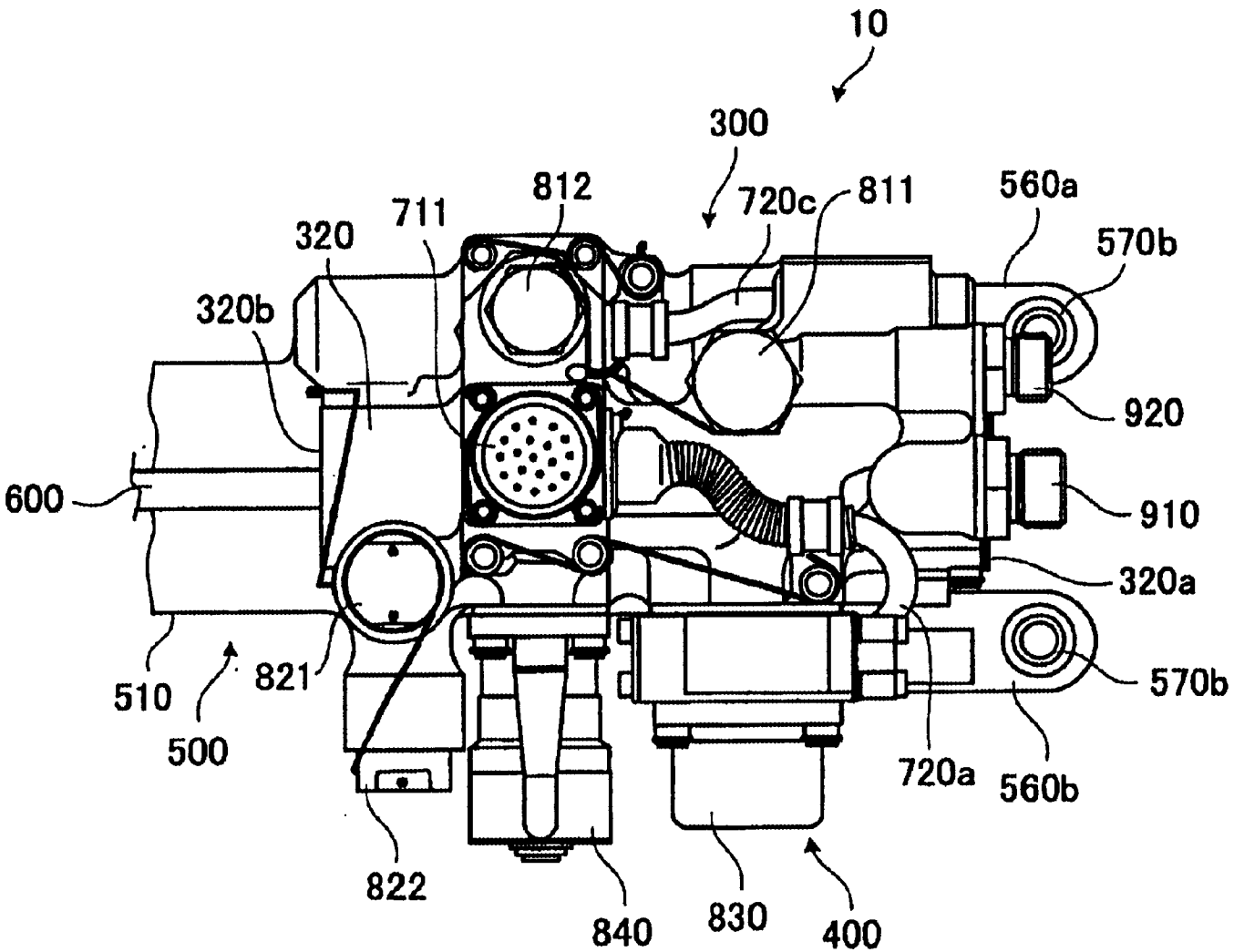
FIG. 4 is an enlarged fragmentary plain view of the front end portion of the hydraulic device shown in the FIG. 2.
Figure 5:
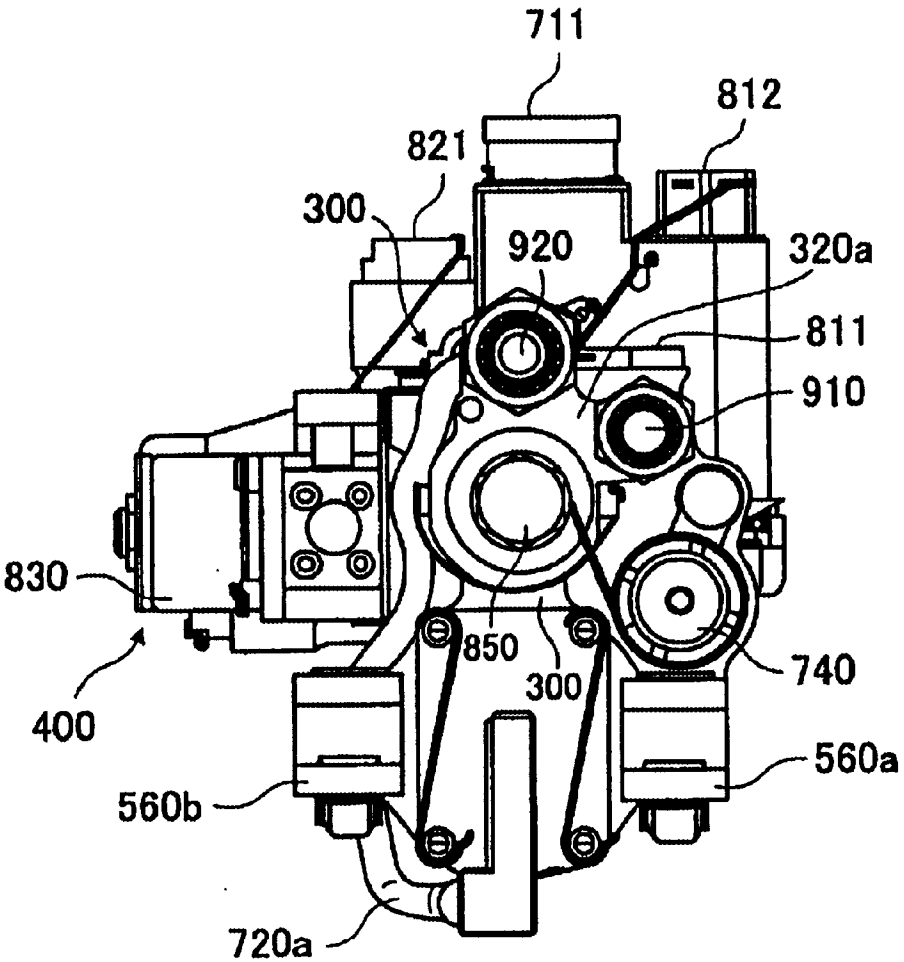
FIG. 5 is an enlarged elevation of the hydraulic device shown in FIG. 1.
Figure 6:
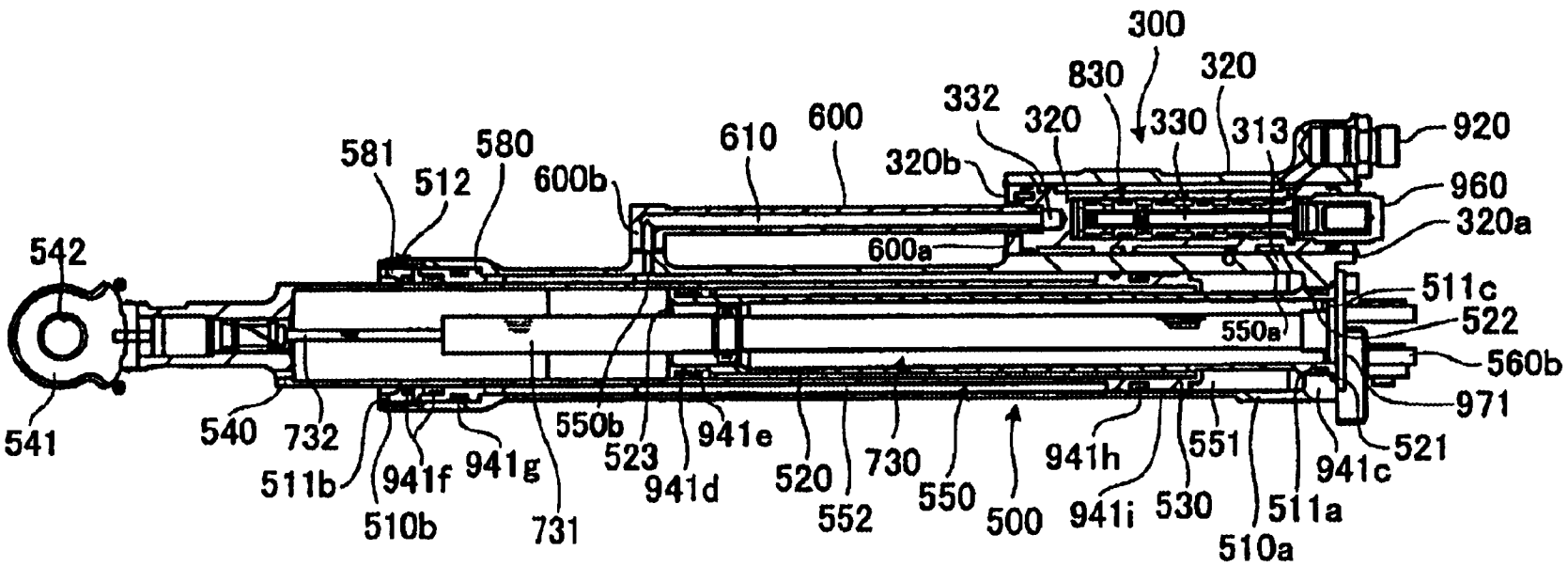
FIG. 6 is a cross-sectional side view of the hydraulic device shown in FIG. 1.
Figure 7:
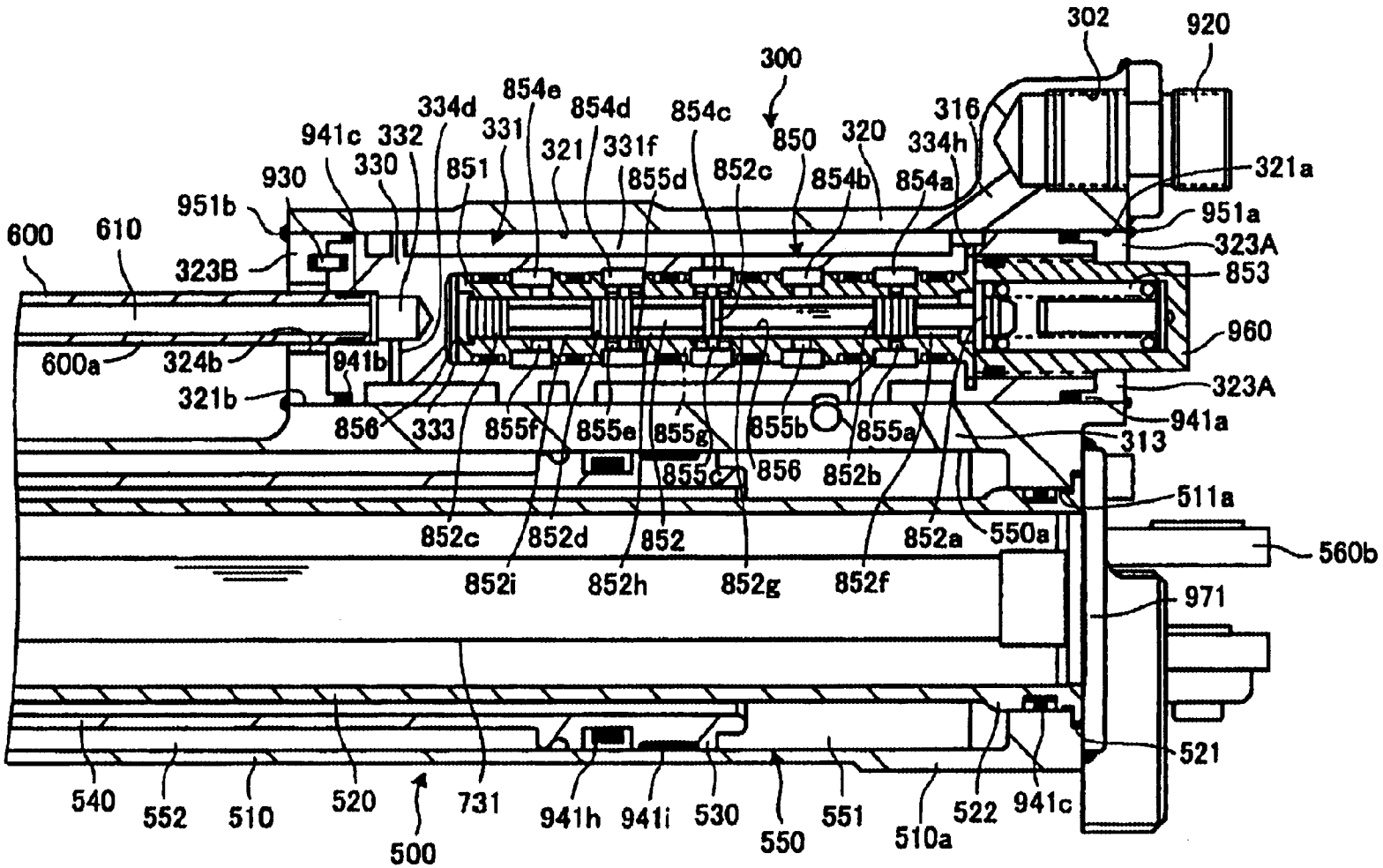
FIG. 7 is an enlarged fragmentary cross-sectional side view of the front end portion of the hydraulic device shown in FIG. 1.
Figure 12:
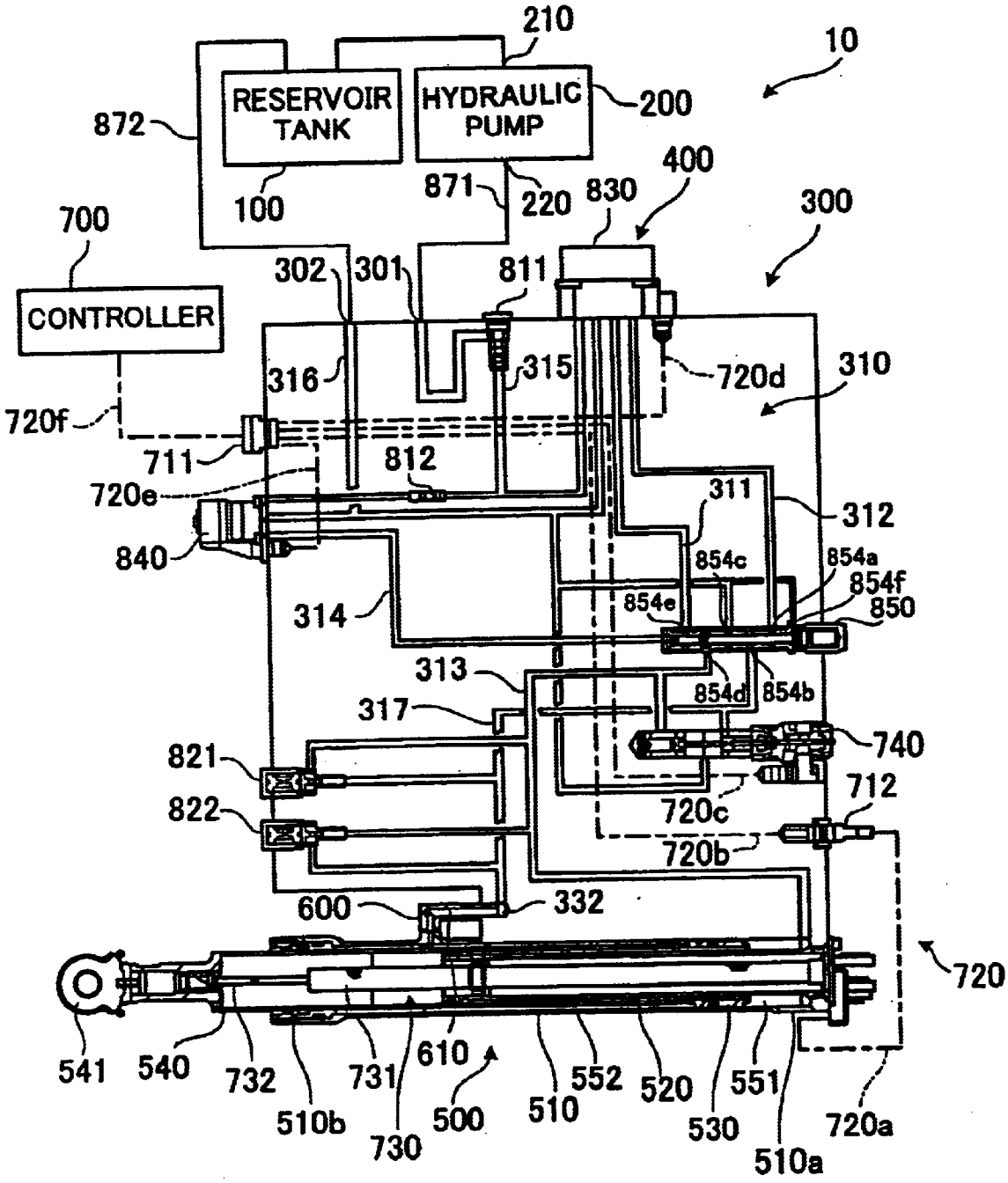
FIG. 12 is a schematic hydraulic circuit diagram for the hydraulic device.

Referring to FIGS. 1 and 2 respectively showing a side and plain view of the hydraulic device 10 of the first preferred embodiment according to the present invention, FIGS. 3 to 5 respectively showing an enlarged fragmentary side, plan and front view of the front portion of the hydraulic device 10, FIG. 6 showing a sectional side view of the main part of the hydraulic device 10, and FIG. 7 showing a fragmentary enlarged sectional view of the front part of the hydraulic device 10, the hydraulic device 10 comprises a reservoir tank 100 reserving a working oil as a working fluid of the present invention, a hydraulic pump 200 to output a high pressure working oil, a fluid distributor unit 300 which is hydraulically connected to the hydraulic pump 200 and the reservoir tank 100 and provided with a passageway means 310, shown in FIG. 12, through which the working oil can flow from the hydraulic pump 200 to the reservoir tank 100, a hydraulic module 400 which is mounted on the hydraulic unit 300 and controls supply of the working oil in the passageway means 310, an actuator 500 which is mounted on the fluid distributor unit 300 and supplied with the working oil through the passageway means 310 to drive an aileron of aircraft not shown, and a connecting member 600 connecting the fluid distributor unit 300 and the actuator 500 to each other.

The reservoir tank 100 reserves the working oil in it, and is hydraulically connected to an inlet port 210 of the hydraulic pump 200 and an exhaust port 302 of the fluid distributor unit 300. The hydraulic pump 200 is driven by an electric motor, not shown, to suck in the working oil from the reservoir tank 100 to increase in pressure and output the high pressure working oil from an outlet port 220 of the hydraulic pump 200 to a supply port 301 of the fluid distributor unit 300.

Referring to FIGS. 6 and 7, the fluid distributor unit 300 includes a passage block 320 having a shape similar to a rectangular solid and formed inside of it with a first hole 321 arranged in parallel with an axial direction of the actuator 500, and an internal body 330 liquid-tightly incorporated into the first hole 321 by means of shrink fit and so forth. The internal body is shaped like a circular cylinder, and formed with a groove means 331 on its outer surface 330*a*. The first hole 321 and the internal body 330 are arranged in a coaxial relationship with each other and in parallel with the axial direction of the actuator 500.

The connecting member 600 has a front and rear end portion, as a first and second end portion of the present invention, 600*a* and 600*b*, and connects at the front end portion 600*a* thereof to the internal body 330, and at the rear end portion 600*b* thereof to the actuator 500.

Various accessories including the hydraulic module 400, the actuator 500 and so forth are mounted on the passage block 320, and electrical wires 720 such as a first and third electrical wires 720*a* and 720*c* are cramped on the passage block 320. Namely, as best shown in FIGS. 3 and 4, a first electrical connector 711, a first check valve 811 and a first relief valve 821 are mounted on the upper outer surface of the passage block 320. An electro-hydraulic servo valve 830 as a first valve means of the hydraulic module 400 of the present invention, a bypass solenoid valve 840 and a second relief valve 822 are mounted on the left side outer surface of the passage block 320. A supply port connector 910 and an exhaust port connector 920 are attached to the front side of the passage block 320 as shown in FIGS. 3, 4 and 5. The support port connector 910 is screwed into the supply port 301 of the passage block 320 and connects an oil supply pipe 871, shown in FIG. 12. The oil supply pipe 871 is connected to the inlet port 210 of the hydraulic pump 200. The exhaust port connector 920 is screwed into the exhaust port 302 of the passage block 320 and connects an oil exhaust pipe 872, shown in FIG. 12. The oil exhaust pipe 872 is connected to the reservoir tank 100. The actuator 500 is mounted on the lower surface side of the passage block 320 as best seen in FIGS. 1 and 3.

The fluid distributor unit 300 is provided with the passageway means 310, shown in FIG. 12, consisting a first and second passageway 311 and 312 respectively hydraulically communicating the electro-hydraulic servo valve 830 and the groove means 331 of the internal body 330 with each other, a third passageway 313 hydraulically communicating the groove means 331 of the internal body 330 and the actuator 500 with each other, and a fourth passageway 317 hydraulically communicating the groove means 331 of the internal body 330 and the connecting member 600 with each other. The first to third passageways 311 to 313 are formed inside of the passage block 320, and the fourth passageway 317 is formed in the internal body 330.

Referring to FIG. 7, the first hole 321 of the passage block 320 is formed as a through hole having a front and rear opening end 321*a* and 321*b* at each end thereof, and liquid-tightly receives the internal body 330 in the first hole 321. The rear opening end 321*b* of the first hole 321 is closed up by a rear cover member 323B screwed into the rear end portion of the first hole 321 of the passage block 320 and sealed by sealant 951*b*. The rear cover member 323B and the internal body 330 are joined to each other, with a seal 941*b* disposed between them, by a locking pin 930 as locking means of the present invention to set the rotational position of the internal body 330 with respect to the passage block 320 at the predetermined angle position so as to hydraulically communicate the groove means 331 of the internal body 330 and the passageway means 310 of the passage block 320 with each other. The rear cover member 323B has a through hole 324*b* in the center of it to cover the rear opening 321*b* of the passage block 320.

The internal body 330 is formed at its rear end portion 330*c* with a connecting chamber 332 informed into a stepped bore. The front end portion 600*a* of the connecting member 600 passes through the through hole 324*b* of the rear cover member 323B, and is received in the connecting chamber 332. The front end portion 600*a* of the connecting member 600 and the rear end portion 330*c* of the internal body 330 are connected to each other liquid-tightly with a seal 941*c* disposed between them, so as to hydraulically communicate the connecting chamber 332 of the internal body 330 and a channel 610 formed inside of the connecting member 600 with each other. The front opening end 321*a* is closed up by a spring retainer 960. The spring retainer 960 is screwed into the internal body 330, and held tight at its enlarged portion by the front end portion of the internal body 330 and the rear end portion of a front cover member 323A screwed into the front end portion of the first hole 321 of the passage block 320. Accordingly, the front cover member 323A and the rear cover member 323B hold tightly the internal body 330 liquid-tightly with a seal 941*a* disposed between them. The front opening end 321*a* of the first hole 321 are sealed with sealant 951*a*.

Figure 9:
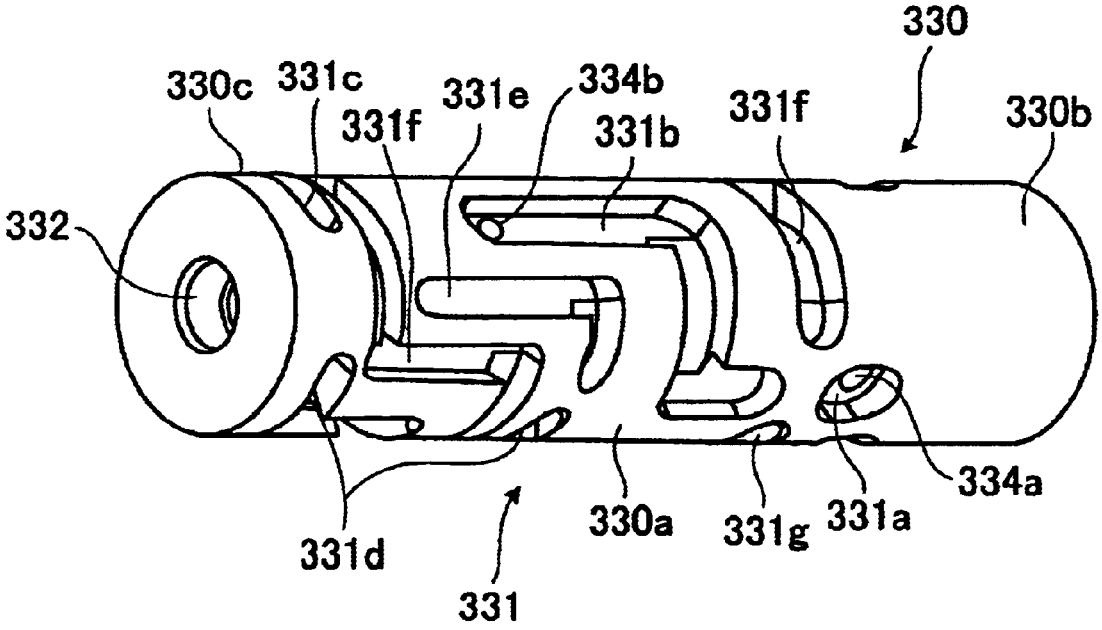
FIG. 9 is a perspective view of an internal body used for the hydraulic device.
Figure 10:
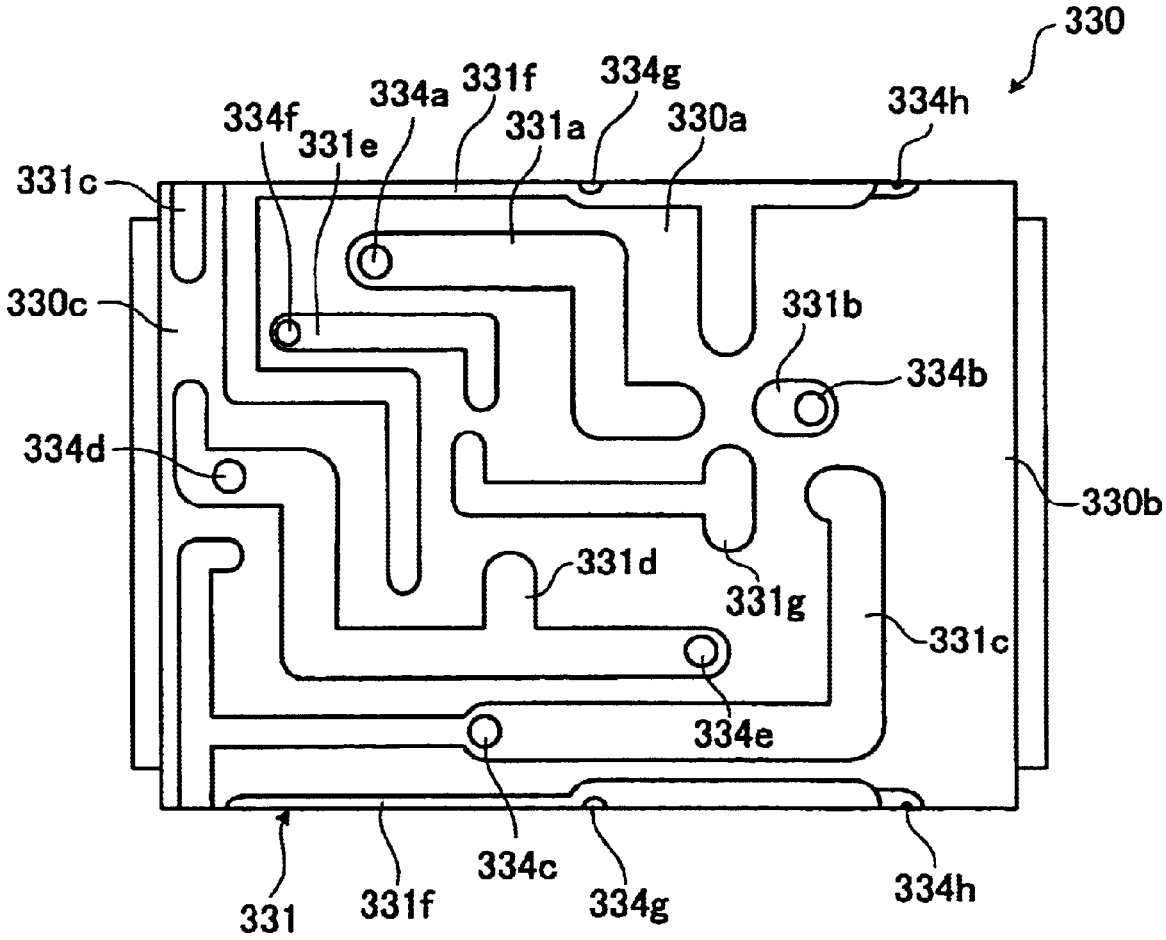
FIG. 10 is a development of figures of grooves formed on the outer surface of the internal body.
Figure 11:
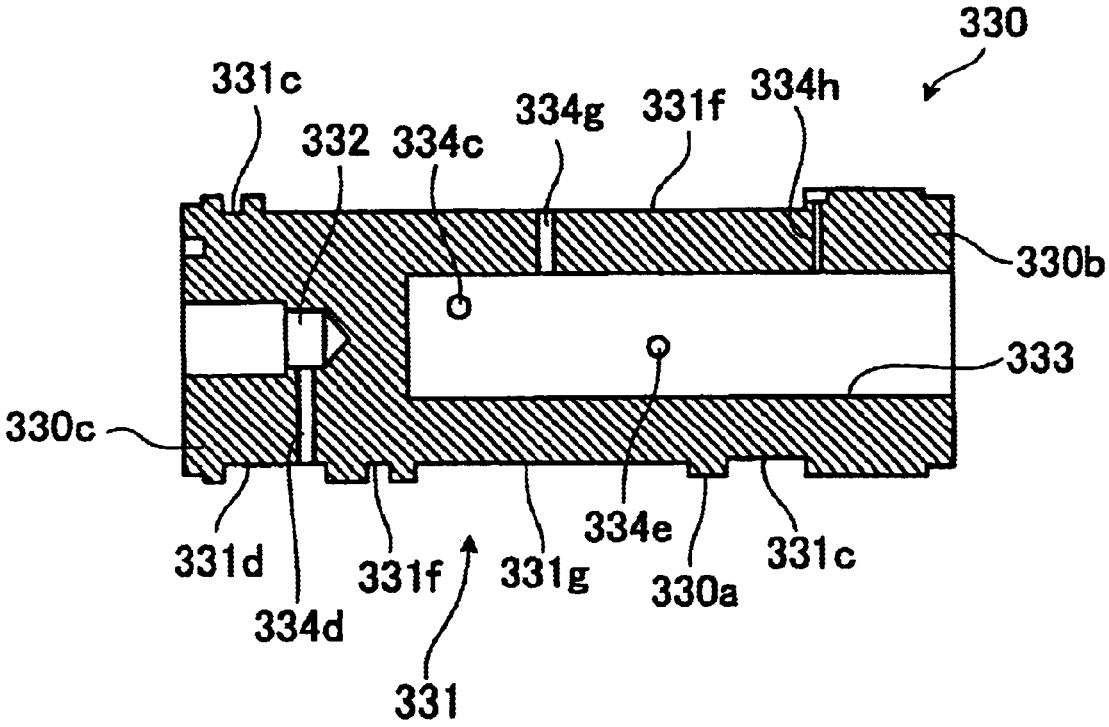
FIG. 11 is a cross-sectional side view of the internal body.

Referring to FIGS. 7, 9 and 11, the internal body 330 is further formed on its outer surface 330*a* with a groove means 331: a first groove 331*a*, a second groove 331*b*, a third groove 331*c*, a fourth groove 331*d*, a fifth groove 331*e*, a sixth groove 331*f* and a seventh groove 331*g* that are different from each other in figure as seen in FIG. 10 showing a development elevation of the outer surface 330*a* of the internal body 330.

The first groove 331*a* is connected to the first passageway 311 shown in FIG. 12 to be hydraulically held in communication with the electro-hydraulic servo valve 830. The second groove 331*b* is connected to the second passageway 312 shown in FIG. 12 to be hydraulically held in communication with the electro-hydraulic servo valve 830. The third groove 331*c* is connected to the third passageway 313 shown in FIG. 12 to be hydraulically held in communication with a first chamber 551 of the actuator 500. The fourth groove 331*d* is connected to the connecting chamber 332 through a fourth rear radially extending passageway 334*d* formed in the internal body 330. The fifth groove 331*e* is connected to a pilot pressure passageway 314 shown in FIG. 12 to be hydraulically held in communication with the bypass solenoid valve 840. The sixth groove 331*f* is connected to an exhaust passageway 316 shown in FIG. 12 to be hydraulically held in communication with the exhaust port 302 of the passage block 320. The seventh groove 331*g* functions as a part of a supply passageway 315 shown in FIG. 12 to be hydraulically held in communication the bypass solenoid valve 840. The fourth rear radially extending passageway 334*d* and the connecting chamber 332 functions as the fourth passageway 317.

The internal body 330 is, as shown in FIG. 7, formed inside thereof with a second hole 333, as a bottomed hole, which extends in parallel with the axial direction of the actuator 500 and in a coaxial relationship with the internal body 330. The second hole 333 is respectively hydraulically connected to the first groove 331*a* through a first radially extending passageway 334*a*, to the second groove 331*b* through a second radially extending passageway 334*b*, to the third groove 331*c* through a third radially extending passageway 334*c*, to the fourth groove 331*d* through a fourth front radially extending passageway 334*e*, to the fifth groove 331*e* through a fifth radially extending passageway 334*f*, and to the sixth groove 331*f* through a sixth rear radially extending passageway 334*g* and a sixth front radially extending passageway 334*h*.

The second hole 333 receives a mode selector valve 850 as a second valve means of the present invention. The mode selector valve 850 comprises a valve sleeve 851 formed with a third hole 856 which extends in parallel with the axial direction of the actuator 500 and in the coaxial relationship with the internal body 330, a valve spool 852 slidably received in the third hole 856 of the valve sleeve 851, and a coil spring 853 retained on the spring retainer 960 and urging the valve spool 852 backward toward the connecting chamber 332.

The valve sleeve 851 is provided at its outer surface with five annular grooves: a first annular groove 854*a*, a second annular groove 854*b*, a third annular groove 854*c*, a fourth annular groove 854*d* and a fifth annular groove 854*e* aligned in turn from the front side to the rear side of the valve sleeve 851. The first annular groove 854*a* is connected to the second groove 331*b* through the first radially extending passageway 334*a* of the internal body 330; the second annular groove 854*b* is connected to the fourth groove 331*d* through the fourth front radially extending passageway 334*e*; the third annular groove 854*c* is connected to the fifth groove 331*f* through the fifth radially extending passageway 334*g*; the fourth annular groove 854*d* is connected to the third groove 331*c* through the third radially extending passageway 334*c*; the fifth annular groove 854*e* is connected to the first groove 331*a* through the second radially extending passageway 334*b*. The peripheral portion of the front end of the valve sleeve 851 is faced to the sixth front radially extending passageway 334*h* of the internal body 330 to discharge a leakage therefrom.

Figure 8:
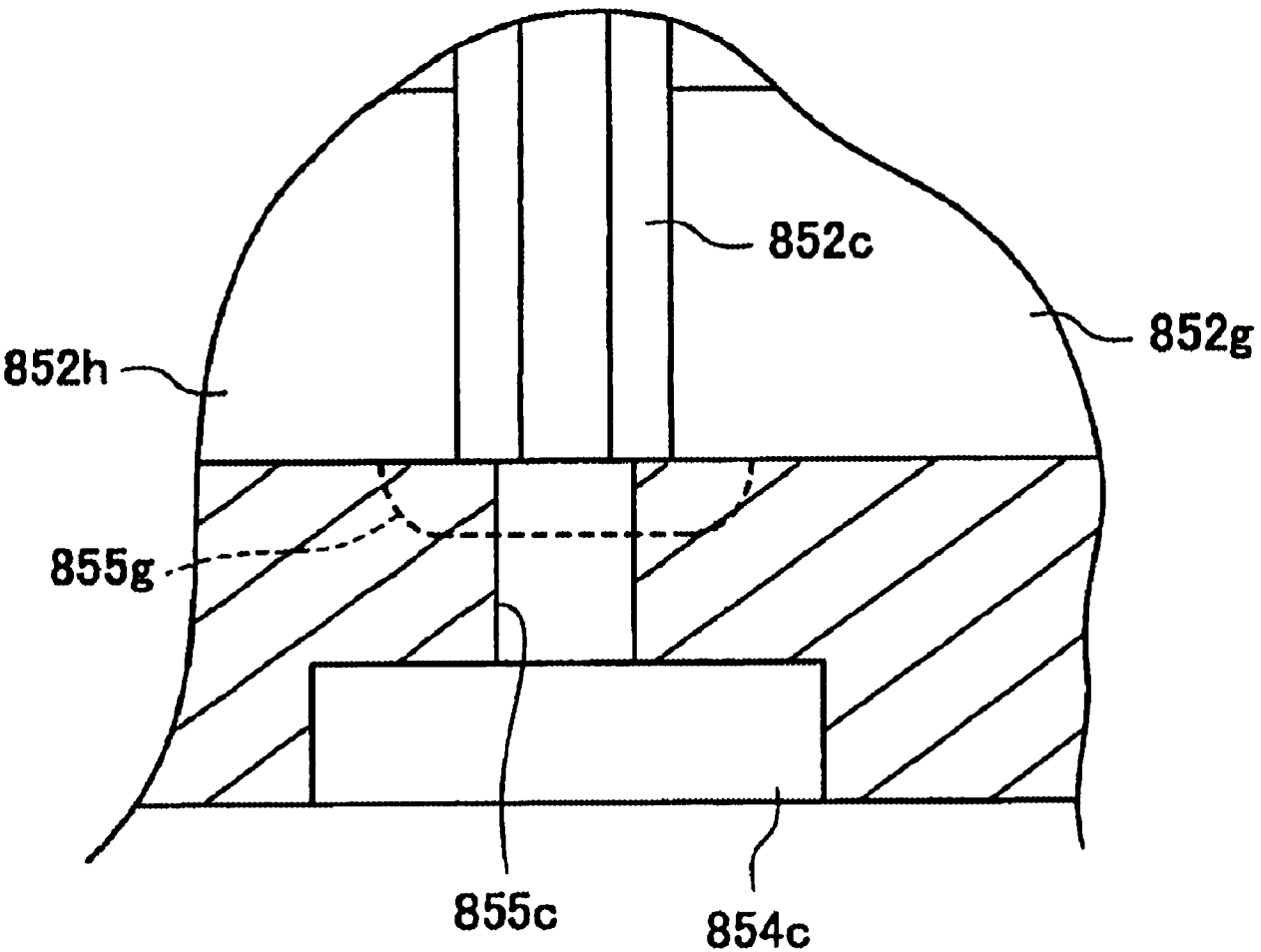
FIG. 8 is an enlarged fragmentary cross sectional and broken view of a mode selector valve used for the hydraulic device shown in FIG. 7.

The grooves 854*a* to 854*e* are also hydraulically connected to the third hole 856 of the valve sleeve 851 respectively through six radially extending passageways 855*a* to 855*f* formed in the valve sleeve 851. A first radially extending passageway 855*a* is positioned in the first annular groove 854*a*, a second radially extending passageway 855*b* in the second annular groove 854*b*, a third radially extending passageway 855*c* in the third annular groove 854*c*, a fourth front radially extending passageway 855*d* and a fourth rear radially extending passageway 855*e* in the fourth annular groove 854*d*, a fifth radially extending passageway 855*f* in the fifth annular groove 854*e* respectively. In the third annular groove 854*c*, as shown in FIG. 8 of the enlarged fragmentary sectional side view of the valve sleeve 851, at the position being apart in an inner peripheral direction of the valve sleeve 851 from the third radially extending passageway 854*c*, there is provided with an axially extending passageway 855*g*.

The valve spool 852 is formed with five lands in the same diameter: a first land 852*a*, a second land 852*b*, a third land 852*c*, a fourth front land 852*d* and a fifth land 852*e* respectively having a seal on its peripheral outer surface and arranged in turn from the front end portion to the rear end portion thereof. There is, therefore, provided between the first land 852*a* and the second land 852*b* with a first valve groove 852*f*, between the second land 852*b* and the third land 852*c* with a second valve groove 852*g*, between the third land 852*c* and the fourth land 852*d* with a third valve groove 852*h*, and between the fourth land 852*d* and the fifth land 852*e* with a fourth valve groove 852*i*.

The selector valve 850 can be shifted by supply or discharge of a pilot pressure working oil in the pilot pressure passageway 314 to assume two different positions: a first operation mode position (a normal position) and a second operation mode position (a bypass position).

In the first operation mode position, the pilot pressure working oil is delivered in the pilot passageway 314 and pushes the valve spool 852 to move forward from the position shown in FIG. 7 with compressing the coil spring 853. This results in that the first radially extending passageway 855*a* and the second radially extending passageway 855*b* are held in communication with each other through the second valve groove 852*b*; the fourth rear radially extending passageway 855*e* and the fifth radially extending passageway 855*f* being held in communication with each other through the fourth valve groove 852*i*; and the third radially extending passageway 855*c* being opened to be held in communication with the third valve groove 852*c*. On the contrary, the fourth front radially extending passageway 855*d* is closed up by the fourth land 852 so that the communication is blocked off between the fourth front radially extending passageway 885*d* and the third radially extending passageway 885*c* through the third valve groove 852*h*, and the axially extending passageway 855*g* is closed up by the third land 852*c* so that the communication is blocked off between the third valve groove 852*h* and the second radially extending passageway 855*b*. Hereby the first passageway 311 and the third passageway 313 are communicated with each other through the second valve groove 852*g* of the valve spool 852, and the second passageway 312 and the fourth passageway 317 are also communicated with each other through the fourth valve groove 852*i*. The working oil, therefore, can be supplied from the first passageway 311 to the first chamber 551 of the actuator 500 through the mode selector valve 850 and the third passageway 313, and from the second passageway 312 to a second chamber 552 of the actuator 500 through the mode selector valve 850 and the fourth passageway 317. This means that an annular piston 530 of the actuator 500 is driven to move in its axial direction according to the differential pressure between pressures in the first and second chambers 551 and 552. On the other hand, the exhaust passageway 316 is not held in communication with the first to fourth passageways 311, 312, 313 and 317 through the mode selector valve 850.

In the second operation mode position, the pilot pressure is discharged from the pilot pressure passageway 314 so that the valve spool 852 is pushed backward by the coil spring 853 to be moved to the position shown in FIG. 7. This results in that the first radially extending passageway 855*a* is closed off by the first land 852*a* of the valve spool so that the communication is blocked off between the first radially extending passageway 855*a* and the other radially extending passageway 855*b* to 855*f*; the second radially extending passageway 855*c* being opened to be held in communication with only the second valve groove 852*g*; the third radially extending passageway 855*c* being closed up by the third land 852*c* so that the communication is blocked off between the third radially extending passageway 855*c* and the other radially extending passageways 855*a*, 855*b*, 855*d*, 855*e* and 855*f*; the fourth front radially extending passageway 855*d* being opened to be held in communication with the third valve groove 852*h*; the fourth rear radially extending passageway 855*e* being closed up so that the communication is blocked off between the fourth rear radially extending passageway 855*e* and the other radially extending passageways 855*a*, 855*b*, 855*c* and 855*f*; the fifth radially extending passageway 855*f* being opened. At a time, the axially extending passageway 855*g* communicates the second valve groove 852*g* and the third valve groove 852*c* with each other. Hereby the first and second passageways 311 and 312 are not held in communication with the third and fourth passageways 313 and 317, while the third and fourth passages 313 and 317 are held in communication with each other through the axially extending passageway 855*g* of the mode selector valve 850. The working oil, therefore, can flow between the first chamber 551 and the second chamber 552 of the actuator 500 through the third passageway 313, the axially extending passageway 855*g* of the mode selector vale 850, and the fourth passageway 317. This enables the aileron to be swingable freely from this actuator 500, and it can be driven by another actuator, not shown, connected to the aileron.

FIGS. 6 and 7 shows cross-sectional view of the actuator 500. The actuator 500 comprises a cylindrical shell 510 having a front end portion, as a first end portion of the present invention, 510*a* and a rear end portion, as a second end portion of the present invention, 510*b* and formed with a front and rear opening end 511*a* and 511*b* at the front and rear end portion 510*a*, 510*b* respectively, an inner tube 520 being shorter than the cylindrical shell 510 and disposed inside of the cylindrical shell 510, an annular piston 530 slidably received in the space between the inner surface of the cylindrical shell 510 and the outer surface of the inner tube 520, and a tubular piston rod 540 integrally connected to the rear side of the annular piston 530 and extending backward to project from the rear opening end 511*b* of the cylindrical shell 510.

The cylinder shell 510 is formed by casting in one piece with the passage block 320 so that the front end portion 510*a* of the cylinder shell 510 is integrally connected to the lower portion of the passage block 320, and that the rear end portion 510*b* projects backward in the axial direction of the actuator 500 from the rear end portion 320*b* of the passage block 320. The cylindrical shell 510, the inner tube 520, annular piston 530, and the tubular piston rod 540 are arranged in a coaxial relationship with each other.

The front opening end 511*a* of the cylindrical shell 510 is smaller in diameter than the inner surface of an intermediate portion between the front and rear opening ends 511*a* and 511*b*, and the rear opening end 511*b* is larger in diameter than the inner surface of the intermediate portion. The front opening end 511*a* is closed up by a front circular plate 971 bolted on the front end portion 510*a* of the cylindrical shell 510. The inner tube 520 is formed at its front end with a flange portion 521 to be held tight by the front circular plate 971 and the front end portion 510*a* of the cylindrical shell 510.

The inner tube 520 is also formed at the rear side of and next to the flange portion 521 with a front enlarged portion 522 and at its rear end with a rear enlarged portion 523 in the same diameter as the front enlarged portion 522. The front enlarged portion 522 of the inner tube 520 has a front seal 941*c* disposed on its peripheral surface to liquid-tightly contact to the first end portion 510*a* of the cylindrical shell 510. The rear enlarged portion 523 of the inner tube 520 has two rear seals 941*d* and 941*e* disposed on its peripheral surface to slidably and liquid-tightly contact the inner surface of the tubular piston rod 540.

The cylindrical shell 510 is formed at its second end portion 510*b* with an enlarged end portion 512 to receive an end sleeve 580. The end sleeve 580 is held tight by a reduced intermediate portion next to the enlarged end portion 512 of the cylindrical shell 510 and a locking member 581 screwed into the enlarged end portion 512 of the cylindrical shell 510. The front end portion of the end sleeve 580 is smaller in diameter than the rear end portion of it, and extends forward in the reduced intermediate portion of the cylindrical shell 510 near a rear inlet/outlet port 550*b* of the actuator 500, and thereby functions as a stopper of the annular piston 530 to prevent it from moving excessively backward. The end sleeve 580 is provided with two inner rear seals 941*f* and an outer rear seal 941*g* respectively disposed on its inner and outer surface of the end sleeve 580 respectively. The inner rear seals 941*f* contact liquid-tightly and slidably the peripheral surface of the tubular piston rod 540, and support the tubular piston rod 540. The outer rear seal 941*g* contacts the inner surface of the rear end portion of the cylindrical shell 510.

The cylindrical shell 510, the inner tube 520, the annular piston 530 and the tubular piston rod 540 define a cylinder chamber 550. The cylinder chamber 550 is partitioned by the annular piston 530 into two chambers: the first chamber 551 is defined by the cylindrical shell 510, the inner tube 520 and the annular piston 530, and the second chamber 552 is defined by the cylindrical shell 510, the annular piston 530 and the tubular piston rod 540. The cylindrical shell 510 is formed at the front end side of the first chamber 551 with a front inlet/outlet port 550*a* connected to the first chamber 551, and at the rear end side of the second chamber 552 with the rear inlet/outlet port 550*b* connected to the second chamber 552. The rear inlet/outlet port 550*b* is positioned apart from the rear end portion 320*b* of the passage block 320 in the axial direction of the actuator 500, and connected to the rear end portion 600*b* of the connecting member 600 to hydraulically communicate the second chamber 552 of the actuator 500 and the connecting chamber 332 of the internal body 330 through the channel 610 of the connecting member 600.

The cylindrical shell 510 is integrally formed at its front end portion 510*a* with two connectors 560*a* and 560*b* respectively having a double roller rod end bearing 570*a*, 570*b* for connecting to a frame of the wing. On the other hand, the tubular piston rod 540 is provided at its rear end portion with an eye 542 used for connecting to the aileron.

Inside of the tubular piston rod, there is provided with a linear variable differential transducer 730 to provide critical position feedback essential for flight control. The linear variable differential transducer 730 has a sensing tube 731 connected at its front end to the front circular plate 971 and supported at its intermediate portion with the inner tube 520 of the actuator 500 through a ring member 523, a sensing rod 732 connected to the rear end portion of the piston rod 540, and a sensing device, not shown, to detect a relative position between the sensing tube 731 and the sensing rod 732. The linear variable differential transducer 730 detects a displacement between the sensing tube 731 and the sensing rod 732 to produce a displacement signal, then outputting its displacement signal to a controller 700, including such as a microcomputer, through the electrical wire 720.

Referring to FIG. 12, there is schematically shown a hydraulic circuit with an electric circuit used for the hydraulic device 10. This drawing shows, for the sake of simplicity, neither an exact figuration nor an exact arrangement of the fluid distributor unit 300 and its hydraulic circuit, and omits the boundary between the internal body 330 and the passage block 320.

The reservoir tank 100 reserves the working oil in it. The hydraulic pump 200 is provided with an inlet port 210 and an outlet port 220. The inlet port 210 is connected to the reservoir tank 100 to suck the working oil in it, and the outlet port 220 is connected 320 through the oil supply pipe 871 to the supply port 301 formed on the passage block 320 to output the high pressured working oil.

The supply passageway 315 is connected at its first end to the supply port 301, at its second end to the electro-hydraulic servo valve 830, and at its third end to the bypass solenoid valve 840; the pilot passageway 314 is connected at its one end to the bypass solenoid valve 840 and at the other end to the fifth groove 331*e* (communicated with the rear end portion of the third hole 856 of the valve sleeve 851) of the internal body 330; the exhaust passageway 316 is connected at its first end to the exhaust port 302, at its second end to the electro-hydraulic servo valve 830, at its third end to the bypass solenoid valve 840, at its fourth end to the sixth groove 331*f* (communicated with the third annular groove 854*c* of the valve sleeve 851) of the internal body 330, at its fifth end to the differential pressure sensing valve 740; the first passageway 311 is connected at its one end to the electro-hydraulic servo valve 830 and at it's the other end to the first groove 331*a* (communicated with the fifth annular groove 854*e* of the valve sleeve 851) of the internal body 330; the second passageway 312 is connected at its end to the electro-hydraulic servo valve 830 and at the other end to the second groove 331*b* (communicated with the first annular groove 854*a* of the valve sleeve 851) of the internal body 330; the third passageway 313 is connected at its first end to the third groove 331*c* (communicated with the second annular groove 854*b* of the valve sleeve 851) of the internal body 330, at its second end to the first chamber 551 of the actuator 500, at its third and fourth end to the first and second relief valve 821 and 822 respectively, and at its fifth end to a differential pressure sensing valve 740; and the fourth passageway 317 is connected at its first end to the fourth groove 331*d* (communicated with the fourth annular groove 854*d* of the valve sleeve 851) of the internal body 330, at its second end to the connecting chamber 332, at its third and fourth end to the first and second relief valve 821 and 822, and at its fifth end to the differential pressure sensing valve 740.

The supply passageway 315 is provided with the first check valve 811 between the supply port 301 and the electro-hydraulic servo valve 830. The first check valve 811, for example comprising a flat poppet, a poppet seat, and a coil spring urging the flat poppet toward the poppet seat, permits the working oil to flow in a direction headed from the electro-hydraulic servo valve 830 to the supply port 301, while preventing its reverse direction flow. The supply passageway 315 is also provided with the second check valve 812 between the first check valve 811 and the bypass solenoid valve 840. The second check valve 812, for example comprising a ball poppet, a poppet seat, and a coil spring urging the ball poppet to the poppet seat, permits the working oil to flow in a direction headed from the first check valve 811 to the bypass solenoid valve 840, while preventing its reverse flow. This second check valve 812 is used to stabilize the operation of the mode selector valve 850 in the first operation mode against pilot pressure fluctuation.

The electro-hydraulic servo valve 830 is connected to the supply passageway 315, the first and second passageways 311 and 312 and the exhaust passageway 316 respectively. Referring mainly to FIG. 12 and additionally to FIGS. 7, 9 and 10, the first passageway 311 is connected to the first groove 331*a* of the internal body 330 to supply the working oil to the fifth valve groove 854*e* of the valve sleeve 851 of the mode selector valve 850 through the first radially extending passageway 334*a* of the internal body 330. The second passageway 312 is connected to the second groove 331*b* of the internal body 330 to supply the working oil to the first annular groove 854*a* of the valve sleeve 851 of the mode selector valve 850 through the second radially extending passageway 334*b* of the internal body 330.

The electro-hydraulic servo valve 830 is electrically connected to the controller 700 through a fourth electrical wire 720*d*, the first electrical connector 711 and a sixth electrical wire 720*f*. The electro-hydraulic servo valve 830 is controlled in response to a first command signal outputted from the controller 700 to translate its first command signal directly into the working oil flows in the first and second passageways 311 and 312 at each pressure level in response to the first command signal, reducing the working oil supplied from the supply passageway 315.

The bypass solenoid valve 840 is consisted of a shift valve switched by a plunger of its solenoid, which are not shown, to assume two different positions consisting a first position (an energized position) where the solenoid is energized so that the bypass solenoid valve 840 communicates the supply passageway 315 and the pilot pressure passageway 314 with each other, while blocking the exhaust passageway 316, and outputs the pilot pressure in the pilot pressure passageway 314 to switch the mode selector valve 850 to the first operation mode position, and a second position (a de-energized position) where the solenoid is de-energized so that the bypass solenoid valve 840 communicates the pilot pressure passageway 314 and the exhaust passageway 316 with each other, while blocking the supply passageway 315, and discharges the pilot pressure in the pilot pressure passageway 314 to switch the mode selector valve 850 to the second operation mode position.

Namely, in the first position, the pilot pressure oil is introduced into the connecting chamber 332 and applies its pressure to the rear side of the fifth land 852*e* of the valve spool 852 of the mode selector valve 850 to move the valve spool 852 forward with compressing the coil spring 853. In the second position, the pilot pressure oil is discharged, and thereby does not apply its pressure to the valve spool 852. The valve spool 852, therefore, moves backward by an elastic force of the coil spring 853.

The bypass solenoid valve 840 is electrically connected to the controller 700 through a fifth electrical wire 720*e*, the first electrical connector 711 and the sixth electrical wire 720*f*, and is controlled in response to a second command signal outputted from the controller 700 to supply or discharge the pilot pressure in the pilot pressure passageway 314.

The mode selector valve 850 is respectively connected the first, second, third, fourth, pilot pressure and exhaust passageways 311, 312, 313, 317, 314 and 316 through the groove means 331 of the internal body 330. The mode selector valve 850 is shiftable in response to supply and discharge of the pilot pressure oil in the pilot passageway 314 to assume the first and second operation mode positions as described above.

The differential pressure sensing valve 740 is connected to the third passageway 313, the fourth passageway 317 and the exhaust passageway 316, and detects differential pressure between the first and second chambers 551 and 552 to monitor the status of an entire aileron system, not shown, for correcting for irregularities such as force-fighting. The differential pressure sensing valve 740 outputs its detecting signal to the controller 700 through the third electrical wire 720*c*, the first electrical connector 711 and the sixth electrical wire 720*f*.

The first relief valve 821 and the second relief valve 822 are installed in parallel relationship with each other across the third and fourth passageways 313 and 317 to be held in communication with the third passageway 313 and the fourth passageway 317. The first and second relief valves 821 and 822 respectively comprise, for example, a flat face poppet held against a flat seat by a spring which are not shown. The first relief valve 821 opens to permit a flow of the working oil from the fourth passageway 317 to the third passageway 313 when a pressure in the fourth passageway 317 becomes higher than a pressure value determined by the spring, while it closes to block its reverse flow when it does not. On the other hand, the second relief valve 822 opens to permit a flow of the working oil from the third passageway 313 to the fourth passageway 317 when a pressure in the third passageway 313 becomes higher than a pressure value determined by the spring, while it closes to block its reverse flow when it does not. They are set in opposite flow directions to protect cylinder circuits (including the third and fourth passageways 313 and 317) from pressure surges, because any over-pressure in one circuit of the cylinder circuits is relieved into the opposite circuit.

The hydraulic device 10 also has the electric circuit in addition to the above-described hydraulic circuit.

The controller 700 includes the microcomputer, not shown, and is electrically connected through the first electrical connector 711. The controller 700 also receives an operational electrical signal from an operating unit, not shown, operated by a pilot.

The first electrical wire 720 is connected at its one end to the linear variable differential transducer 730 and at its other end to the second electrical connector 712; the second electrical wire 720*b* is connected at its one end to the second electrical connector 712 and at its other end to the first electrical connector 711; the third electrical wire 720*c* is connected at its one end to the differential pressure sensing valve 740 and at its other end to the first electrical connector 711; the fourth electrical wire 720*d* is connected at its one end to the electro-hydraulic servo valve 830 and at its other end to the first electrical connector 711; the fifth electrical wire 720*e* is connected at its one end to the bypass solenoid valve 840 and at its other end to the first electrical connector 711. The controller 700, therefore, receives the detecting signals from the linear variable differential transducer 730 and the differential pressure sensing valve 740 through the first electrical connector 711, and respectively outputs the first and second command signal to the electro-hydraulic servo valve 830 and the bypass solenoid valve 840 through the first electrical connector 711.

The operation of the hydraulic circuit with the electric circuit is as follows:

When the electric circuit is activated, the controller 700 receives the operational electrical signal outputted from the operating unit and the detecting electrical signals produced and outputted from the linear variable differential transducer 730 and the differential pressure sensing valve 740, and then outputs the first command electrical signal to the electro-hydraulic servo valve 830 and the second command electrical signal to the bypass solenoid valve 840. When the controller 700 commands the actuator 500 to stroke to a specific position, a corresponding voltage is sent to the electro-hydraulic servo device 830.

Meanwhile the electric motor drives the hydraulic pump 200 to suck the working oil from the reservoir tank 100 through the inlet port 210 and increase in pressure, then outputting its high pressure working oil to the oil supply pipe 871 through the outlet port 220. This working oil runs into the distributor unit 300 from the supply port 301 thereof, and is delivered to the electro-hydraulic servo valve 830 and the bypass solenoid valve 84 through the supply passageway 315. In this supply passageway 315, the first check valve 811 prevents reverse flow heading from the electro-hydraulic servo valve 830 and the bypass solenoid valve 84 to the supply port 301 in the event of a gust, and the second check valve 812 stabilizes the operation of the mode selector valve 850 in the first operation mode position against pilot pressure fluctuation.

The electro-hydraulic servo valve 830 receives the first command signal from the controller 700 through the sixth electrical wire 720*f*, the first electrical connector 711 and the fourth electrical wire 720*d* and modulates the working oil in the supply passageway 315 to output a first chamber working oil in the first passageway 311, and a second chamber working oil in the second passageway 312, respectively obtained by discharging a part of working oil in the supply passageway 315 from the exhaust passageway 316. The first and second chamber working oils are modulated in response to values of the voltages sent from the controller 700.

On the other hand, in normal operation, the bypass solenoid valve 840 receives the second command signal from the controller 700 through the sixth electrical wire 720*f*, the first electrical connector 711 and the fifth electrical wire 720*e*, and outputs the pilot pressure working oil in the pilot pressure passageway 314 to apply its pressure to the rear end side of the valve spool 851 of the mode selector valve 850 and push it forward, which causes the mode selector valve 850 to be shifted to the first operation mode position. The mode selector valve 850, therefore, hydraulically connects the first passageway 311 and the third passageway 313 to each other through the first groove 331*a* and the first radially extending passageway 334*a* of the internal body 330, the fifth annular groove 854*e* and the fifth radially extending passageway 855*f* of the valve sleeve 851, the fourth valve groove 852*i* of the valve spool 852, the fourth rear radially extending passageway 855*e* and the fourth annular groove 854*d* of the valve sleeve 851, the third radially extending passageway 334*c* and the third groove 331*c* of the internal body 330. The mode selector valve 850 also hydraulically connects the second passageway 312 and the fourth passageway 317 to each other through the second groove 331*b* and the second radially extending passageway 334*b* of the internal body 330, the first annular groove 854*a* and the first radially extending passageway 855*a* of the valve sleeve 851, the second valve groove 852*g* of the valve spool 852, the second radially extending passageway 855*b* and the second annular groove 854*b* of the valve sleeve 851, the fourth radially extending passageway 33*e* and the fourth groove 331*d* of the internal body 330.

The first chamber 551 of the actuator 500, hence, can be supplied with the first chamber working oil through the third passageway 313, and the second chamber 552 of the actuator 500 can be supplied with the second chamber working oil through the fourth passageway 317 and the channel 610 of the connecting member 600. This means that the annular piston 530 is pushed backward by the first chamber working oil and pushed forward by the second chamber working oil.

If the first command signal is set and outputted from the controller 700 so that a first chamber working oil pressure is higher than a second chamber working oil pressure, the annular piston 530 moves backward in its axial direction to extend its tubular piston rod 540 from the cylindrical shell 510 to drive the aileron in one direction, with supplying the first chamber working oil to the first chamber 551 and discharging the second chamber working oil from the second chamber 552. If the first command signal is set and outputted from the controller so that a first chamber working oil pressure is lower than a second chamber working oil pressure, the annular piston 530 moves forward in its axial direction to retract its tubular piston rod 540 into the cylindrical shell 510 to drive the aileron in the other direction, with supplying the second chamber working oil to the second chamber 552 and discharging the first chamber working oil from the first chamber 551.

A position of the annular piston 530 varies proportionately with the first command signal from the controller 700.

As the annular piston 530 moves, its position is constantly being monitored by the linear variable differential transducer 730 attached to actuator 500. When the annular piston 530 is reached at its desired position, the electro-hydraulic servo valve 830 shuts off further flow. This essentially locks the actuator 500 in position, until the next first command signal is inputted.

If the aileron does not need to be driven by this hydraulic device 10, the controller 700 does not output the second command signal to the bypass solenoid valve 840. The bypass solenoid valve 840 is shifted to hydraulically connect the pilot pressure passageway 314 and the exhaust passageway 316 to each other, blocking the pilot pressure passageway 314 from the supply passageway 315, which causes the pilot pressure working oil to be discharged from the pilot pressure passageway 314. Accordingly, the pilot pressure does not apply to the valve spool 852, and it moves backward by an elastic force of the coil spring 853. That is, the mode selector valve 850 is shifted to the second operation mode position.

In this position, the mode selector valve 850 blocks the first passageway 311 from the third passageway 313, also the second passageway 312 from the fourth passageway 317, because the fourth land 852*d* of the valve spool 852 closes up the fourth rear radially extending passageway 855*e* of the valve sleeve 851, and the first land 852*b* closes up the first radially extending passageway 855*a*. But the mode selector valve 850 hydraulically communicates the third passageway 313 and the fourth passageway 317 with each other through the axial extending passageway 855*g* of the valve sleeve 851 of the mode selector valve 850. In this position, the actuator 500 is isolated from supply pressure of the working oil, and can be moved by an applied external load such as the other actuator, not shown. This means that the actuator 500 becomes an essentially passive device, incapable of mechanical output.

As described in the above, in this hydraulic device 10, the connecting member 600 connects the second chamber 552 of the actuator 500 and the connecting chamber 332 of the passage block 320 to each other, it is not necessary to extend the passage block 320 in the axial direction of the actuator 500 to the rear inlet/outlet port 550*b* of the actuator 500. The passage block 320 becomes, therefore, shorter and lighter in weight than the passage block of the prior art. Moreover, this hydraulic device 10 can be easily manufactured and reduce its manufacturing cost, because the internal body 330 is formed with groove means 332 on its outer surface and received in the first hole 321 of the passage block 320 and the groove means 332 is held in communication with the passageway means 310 formed in the passage block 320.

The hydraulic device 10 is suitable for driving an aileron, especially a thin aileron, and also suitable for driving spoiler, elevators and rudders of aircraft.

Figure 13:
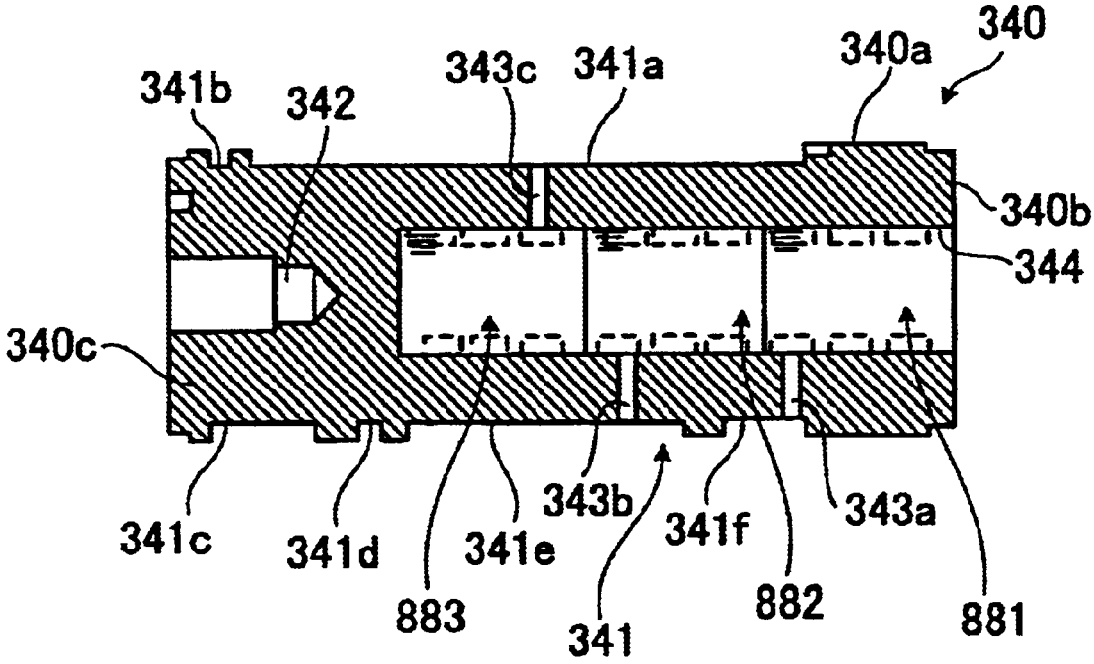
FIG. 13 is a cross-sectional side view of a second preferred embodiment of the internal body used for the hydraulic device according to the present invention.

FIG. 13 shows a cross-sectional side view of a second preferred embodiment of the internal body 340 used for the hydraulic device 10 according to the present invention. The internal body 340 is received in the first hole 321 of the passage block as same as the first embodiment in FIG. 7, which is not shown. The inner body 340 is formed with a plurality of grooves 341 including a first to sixth groove 341*a* to 341*f*, different in figure from FIGS. 9 and 10, on its outer surface 340*a*.

The internal body 340 is formed on its outer surfaces with a groove means 341 including a first to sixth groove 341*a* to 341*f*. It is also formed at its front side with a second hole 344 and at its rear side with a connecting chamber 342. The connecting chamber 342 is formed as a stepped bore and liquid-tightly connected to the front end portion 600*a* of the connecting member 600, not shown in FIG. 13 but the same as in FIG. 7. A plurality of valves are received: for example, a relief valve 881, another relief valve 882 and a check valve 883, each corresponding to the first relief valve 821, the second relief valve 822 and the second check valve 812 shown in FIG. 12, are arranged in tandem in the second hole 344. The second hole 344 is respectively connected to a plurality of radially extending passageways including a first to third radially extending passageway 343*a* to 343*c* formed in the internal body 340. The first radially extending passageway 343*a* hydraulically connects the relief valve 881 and the sixth groove 341*f* of the internal body 340 to each other, the second radially extending passageway 343*b* hydraulically connecting the other relief valve 882 and the fifth groove 341*e* to each other, the third radially extending passageway 343*c* hydraulically connecting the check valve 883 and the first groove 341*a* to each other. These valves, as being such as relief valves and check valves, are shorter than the other valves such as electro-hydraulic servo valves and bypass solenoid valves, which enables them to be easily received in the second hole 344 without extending its length too much and the hydraulic device to be compact.

It will be appreciated that modifications may be made in the present invention.

For example, the passage block 320 can be formed with a first hole having a bottom at its rear side and a front opening at its front side.

The connecting chamber 332 can be provided inside of the passage block 320 at its rear side.

The connecting member 600 can be connected to the passage block 320 or the rear cover member 323B. Moreover the connecting member 600 can be a hose.

The cylindrical shell 511 can be provided independently from the passage block 320, and attached liquid-tightly on the outer surface of the passage block 320.

The hydraulic module 400 can be integrally formed with the passage block 320

The preferred embodiments described herein is therefore illustrative and not restrictive, the scope of the invention being indicated by the appended claims and all variations that come within the meaning of the claims are intended to be embraced therein.

What is claimed is:

1. A hydraulic device comprising:

a reservoir tank reserving a working fluid;

a hydraulic pump sucking in said working fluid from said reservoir tank to increase in pressure and output said working fluid;

a fluid distributor unit hydraulically connected to said hydraulic pump to be supplied with said working fluid from said hydraulic pump and having a passage block formed with a first hole inside thereof and an internal body incorporated fluid-tightly in said first hole of said passage block and formed with a groove means on an outer surface of said internal body, said fluid distributor unit being provided with a passageway means hydraulically connected to said groove means;

a hydraulic module mounted on said passage block and having a first valve means that controls supply of said working fluid in said passageway means;

an actuator mounted on said passage block and comprising a cylindrical shell which has a first end portion and a second end portion and is formed with a cylinder chamber inside thereof, a piston which is movable in said cylinder chamber and defines said cylinder chamber into a first and second chamber at said first and second end portion side of said piston respectively, and a piston rod connecting to said piston and disposed inside of said second chamber;

a connecting member having a first and second end portion and connecting at said first end portion of said connecting member to said fluid distributor unit and at said second end portion of said connecting member to said actuator;

said cylindrical shell being integrally connected at said first end portion thereof to said passage block with said second end portion of said cylindrical shell projecting outward in an axial direction of said actuator from said passage block;

said connecting member being formed with a channel inside thereof to hydraulically communicate said groove means of said internal body and said second chamber of said actuator with each other;

said passageway means of said passage block having a first and second passageway to hydraulically communicate said first valve means of said hydraulic module and said groove means of said internal body with each other, a third passageway to hydraulically communicate said groove means of said internal body and said first chamber of said actuator with each other, and a fourth passageway to hydraulically communicate said groove means of said internal body and said channel of said connecting member with each other.

2. A hydraulic device as set forth in claim 1 in which said internal body is formed in a shape of a circular cylinder.

3. A hydraulic device as set forth in claim 1, in which said first hole and said internal body are arranged in a coaxial relationship with each other and in parallel with said axial direction of said actuator.

4. A hydraulic device as set forth in claim 1, in which said internal body is formed inside thereof with a second hole and a radially extending passageway hydraulically communicating said second hole and said groove means of said internal body with each other, and said internal body receiving a second valve means in said second hole.

5. A hydraulic device as set forth in claim 4, in which said second hole and said second valve means are arranged in a coaxial relationship with said first hole and said internal body and in parallel relationship with said axial direction of said actuator.

6. A hydraulic device as set forth in claim 1, in which said first, second and third passageways are formed inside of said passage block, and said fourth passageway being formed in said internal body.

7. A hydraulic device as set forth in claim 4, in which said second valve means is shiftable to assume two different positions consisting a first operation mode position in which said first and second passageways can be hydraulically held in communication with said third and fourth passageways and a second operation mode position in which said first and second chambers of said actuator can be hydraulically held in communication with each other and blocked from said first and second passageways.

8. A hydraulic device as set forth in claim 7, in which said second valve means communicates said third passageway and said fourth passageway with each other in said second operation mode position.

9. A hydraulic device as set forth in claim 1, in which said internal body is formed at said connecting member side thereof with a connecting chamber to be connected to said connecting member and said groove means of said internal body.

10. A hydraulic device as set forth in claim 4, in which said internal body is formed at said connecting member side thereof with a connecting chamber to be connected to said connecting member and inside of said internal body with a plurality of radially extending passageways to hydraulically communicate said connecting chamber and said second valve means with said groove means.

11. A hydraulic device as set forth in claim 4, in which said second valve means has a valve spool movable in said second hole, and a spring located at an opposite side of said connecting member and urging said valve spool toward said connecting member side.

12. A hydraulic device as set forth in claim 4, in which said second valve means has a valve sleeve received in said second hole and formed with a radially extending passageway to hydraulically communicate an inner and outer side of said valve sleeve with each other, a valve spool movable in said valve sleeve, and a spring located at an opposite side of said connecting member and urging said valve spool toward said connecting member side.

13. A hydraulic device as set forth in claim 4, in which said second valve means has a plurality of valves including at least one of a relief valve and a check valve and arranged in tandem with each other.

14. A hydraulic device as set forth in claim 1, in which said passage block has a cover member which has a through hole and covers an opening end of said first hole of said passage block at said channel side of said passage block, and said first end portion of said connecting member passing through said through hole of said cover member and connected to said internal body to hydraulically communicate said channel of said connecting member and said groove means of said internal body with each other.

15. A hydraulic device as set forth in claim 14, in which said connecting member is connected to said internal body at a center of said connecting member side end of said internal body.

16. A hydraulic device as set forth in claim 14, in which said cover member is secured to said passage block and retains said internal body by a locking means to prevent a rotational movement of said internal body with respect to said passage block.

17. A hydraulic device as set forth in claim 1, in which said connecting member is one of a pipe and a hose.

18. A hydraulic device as set forth in claim 1, in which said connecting member is arranged in a parallel relationship with said axial direction of said actuator.

19. A hydraulic device as set forth in claim 1, in which said cylindrical shell is integrally formed in one piece at said first chamber side thereof with said passage block.

20. A hydraulic device as set forth in claim 1, in which said first valve means of said hydraulic module controls supply of said working fluid in said first passageway and said second passageway.

* * * * *